US011385017B2

(12) United States Patent
Tasyagan

(10) Patent No.: US 11,385,017 B2
(45) Date of Patent: Jul. 12, 2022

(54) REPLACEABLE BARREL BLOCK FOR MANUAL AND SEMI-AUTOMATIC AIR RIFLE AND AIR PISTOLS DRIVEN BY PNEUMATIC SYSTEM (PCP)

(71) Applicant: Bahtiyar Tasyagan, Izmir (TR)

(72) Inventor: Bahtiyar Tasyagan, Izmir (TR)

( * ) Notice: Subject to any disclaimer, the term of this patent is extended or adjusted under 35 U.S.C. 154(b) by 0 days.

(21) Appl. No.: 16/478,479

(22) PCT Filed: Apr. 24, 2018

(86) PCT No.: PCT/TR2018/050184

§ 371 (c)(1),
(2) Date: Jul. 17, 2019

(87) PCT Pub. No.: WO2019/209190

PCT Pub. Date: Oct. 31, 2019

(65) Prior Publication Data

US 2020/0182585 A1 Jun. 11, 2020

(51) Int. Cl.
*F41B 11/73* (2013.01)
*F41B 11/62* (2013.01)

(52) U.S. Cl.
CPC ..... *F41B 11/73* (2013.01); *F41B 11/62* (2013.01)

(58) Field of Classification Search
CPC ..... F41A 11/02; F41A 21/48; F41A 21/484; F41B 11/60; F41B 11/62; F41B 11/73
USPC ..... 124/73, 74; 42/75.02, 44
See application file for complete search history.

(56) References Cited

U.S. PATENT DOCUMENTS 2,331,163 A * 10/1943 Benjamin ..... F41A 21/10 124/69
3,525,319 A * 8/1970 Waldeisen ..... F41B 11/85 124/58
4,370,822 A * 2/1983 Rabino ..... F41A 11/02 124/58
4,457,221 A 7/1984 Geren
6,637,420 B2 * 10/2003 Moritz ..... F41B 11/57 124/73
7,146,973 B2 * 12/2006 Seekman ..... F41A 21/482 124/71
7,237,545 B2 * 7/2007 Masse ..... F41B 11/73 124/75
7,565,902 B2 * 7/2009 Levin ..... F41A 11/02 124/56
8,578,921 B2 * 11/2013 Macy ..... F41B 11/62 124/73

(Continued)

FOREIGN PATENT DOCUMENTS

CN 201463711 U 5/2010
CN 201688758 U 12/2010

(Continued)

*Primary Examiner* — Troy Chambers
*Assistant Examiner* — Benjamin S Gomberg
(74) *Attorney, Agent, or Firm* — Narek Zohrabyan; Phil IP Law Inc.

(57) ABSTRACT

Invention relates to a replaceable barrel block allowing use of barrels of different calibers on a rifle or pistol by means of providing two blocks consisting of barrel and other equipment on the barrel and manually mountable by the user without need for any additional mounting kits for manual and semi-automatic air rifles and air pistols operated pneumatically.

10 Claims, 6 Drawing Sheets

(56) References Cited

U.S. PATENT DOCUMENTS

| | | | | |
|---|---|---|---|---|
| 8,714,144 | B2 * | 5/2014 | Zadra | F41B 11/62 124/74 |
| 9,068,792 | B2 * | 6/2015 | Macy | F41B 11/62 |
| 9,297,607 | B2 * | 3/2016 | Dvorak | F41A 33/06 |
| 9,574,844 | B2 * | 2/2017 | Williams | F41B 11/62 |
| 9,587,903 | B2 * | 3/2017 | Sullivan | F41A 19/12 |
| 9,631,891 | B2 * | 4/2017 | Sullivan | F41B 11/55 |
| 9,719,747 | B2 * | 8/2017 | Tiberius | F41A 33/06 |
| 10,393,464 | B2 * | 8/2019 | Turlakov | F41A 21/485 |
| 2006/0283433 | A1 * | 12/2006 | Gerardo | F41B 11/62 124/74 |
| 2008/0295818 | A1 * | 12/2008 | Styles | F41A 21/48 124/83 |
| 2010/0229445 | A1 * | 9/2010 | Patel | F41A 11/02 42/6 |
| 2012/0132187 | A1 * | 5/2012 | Murray | F41A 9/37 124/77 |

FOREIGN PATENT DOCUMENTS

| | | | | |
|---|---|---|---|---|
| DE | 4107675 | A1 * | 9/1992 | F41G 11/001 |
| DE | 10015021 | C1 * | 12/2001 | F41B 11/62 |
| JP | H06153744 | | 6/1994 | |
| WO | 9417657 | | 8/1994 | |
| WO | 9824304 | | 6/1998 | |
| WO | 2014184766 | | 11/2014 | |

* cited by examiner

REPLACEABLE BARREL BLOCK FOR MANUAL AND SEMI-AUTOMATIC AIR RIFLE AND AIR PISTOLS DRIVEN BY PNEUMATIC SYSTEM (PCP)

THE RELATED ART

Invention relates to use of more than one barrel with different calibers on the same weapon by means of providing a replaceable barrel block for manually loading unto manual and semi-automatic air rifles and air pistols driven by a pneumatic system. A rifle or pistol body consists of two parts, namely, a fixed lower block and a replaceable upper block. Barrels of different calibers are located in the upper blocks provided in advance and having same characteristic features.

The barrel blocks are replaceable on a single weapon quickly, easily and without need for any extra mounting kits or equipment whenever desired by the user. Thus, ammunition of different calibers can be used with the same gun.

BACKGROUND OF THE INVENTION

In the related art there is only one single barrel block for air rifles and air pistols with pneumatic system. Therefore, the caliber of the barrel on the gun determines the ammunition to be used.

Some studies were conducted to eliminate this problem and offer the user an alternative in using ammunition of different caliber with the same gun by means of replacing the barrel. In the embodiments known in the related art it is considerably difficult to mount barrels of different calibers onto the gun and such actions are of nature that cannot be made by users.

When barrel replacement is desired, first, a barrel block is dismantled, then, parts correlated with the caliber of the ammunition such as an ammunition needle (firing pin), spring, loading lever etc., are removed from the barrel block.

Second, the parts, such as another ammunition needle (firing pin), spring, loading lever etc., are placed in the barrel bock again in a manner matching one another.

Probable non-matching parts or any mistakes made during mounting of the barrel block will not only prevent functioning of the rifle or pistol but also may pose a risk of serious bodily damage to the user.

Moreover, appropriate equipment must also be on hand in order to conduct all of the barrel changes discussed above.

Use of that equipment, dismantling and re-mounting the barrel all require expertise and skill.

This makes the barrel replacement operation impossible for the user.

Furthermore, the dismantling and mounting operations take a long time.

In the system disclosed here, a rifle and pistol consist of two parts, namely the lower block and the upper block. Barrels of desired varying calibers and its accompanying components are placed on the upper block to provide a uniform solution. Thus, an elegant embodiment can be obtained.

With this in mind, it is considerably easy to mount the upper block on the lower block of the rifle. The user has the freedom to use ammunition of different calibers with the same rifle or pistol by means of replacing the previously prepared upper block.

The embodiments in the related art do not allow for placement of the barrel and other auxiliary components in one block and thus do not disclose any replacement of barrel in an efficient way.

PURPOSE OF THE INVENTION

The purpose of this invention is to provide barrel blocks of the same characteristic features as the desired caliber and the ability to place those barrels and its correlated components of different calibers onto such blocks thereby obtaining a transformed gun which allows usage of different calibers and ammunition type with the same rifle or pistol.

In order to achieve this purpose, the rifle and pistol is comprised of two parts, namely, the lower block and the upper block. When the user desires to change the barrel of the rifle or the pistol, both barrel and its correlated components of the weapon are swapped out by help of the upper block all at once. Thus, the rifle or pistol benefits from having different calibers and different caliber ammunition being employed thereon.

Another purpose of the invention is to provide usage for both, manual and semi-automatic rifles and pistols driven by a pneumatic system.

A further purpose of the invention is to allow replacement of the barrel by the user.

Another purpose of the invention is to reduce the time needed for barrel replacement.

A further purpose of the invention is to prevent the risks of having accidents that might arise from mistakes likely to be made during barrel replacement.

Another purpose of the invention is to enable replacement of a barrel without need for any additional equipment.

The structural and characteristic features and all advantages of the invention will be understood better with the figures given below and the detailed description by reference to the figures. Therefore, the assessment should be made based on the figures and the detailed descriptions.

Figure 1:
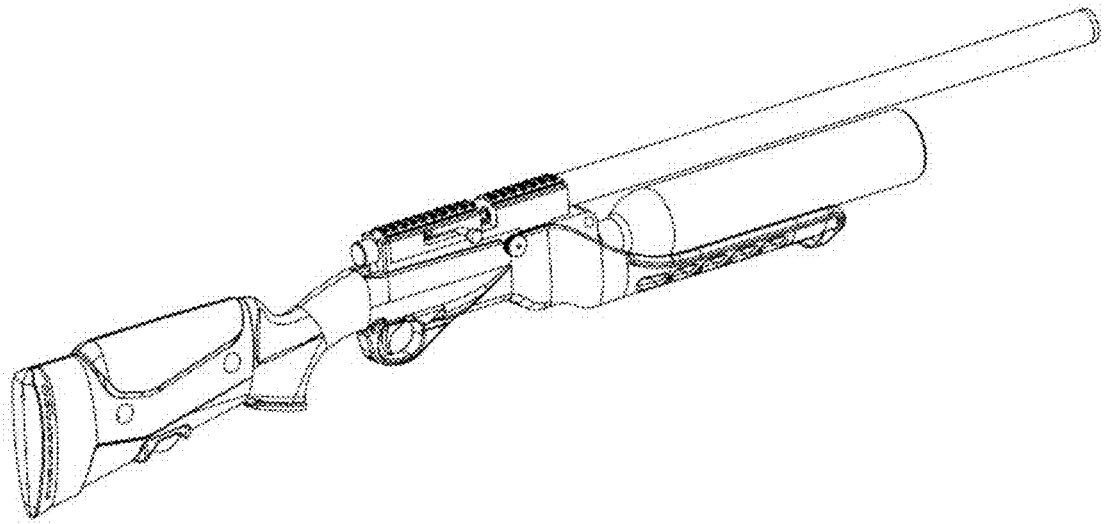
FIG. 1—is a general perspective view of an air rifle with a pneumatic system containing a replaceable barrel block.
Figure 2:
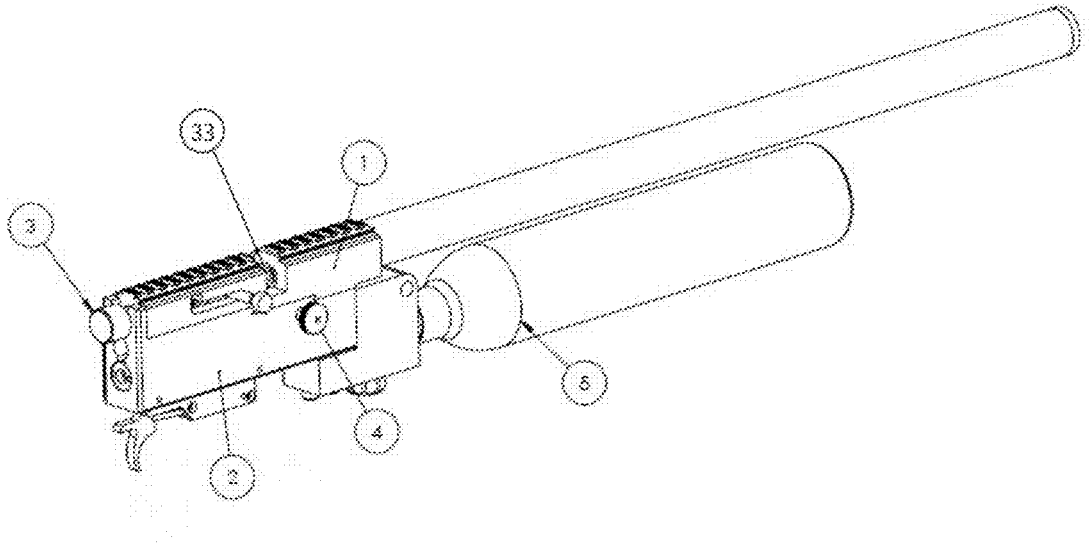
FIG. 2—is a perspective view of an air rifle containing replaceable barrel block with the stock removed.

Part numbers are provided on the figures in order to ensure better understanding of the system.

REFERENCE PART NUMBERS

1—Upper block
2—Lower block
3—Fixing screw
4—Speed adjustment button
5—Air tube
8—Upper block groove
9—Lower block groove
10—Vertically oriented cylindrical motion pin
11—Horizontally oriented fixing screw housing

12—Ammunition sliding pin housing
13—Ammunition sliding pin
14—Cylindrical motion pin housing
15—Barrel housing
16—Barrel jacket connection extension
17—Barrel
18—Barrel connection place
20—Barrel jacket
29—Vertically oriented "U" shape fixing housing
30—Upper Block air passage hole
31—Lower block air passage hole
32—Sealing gasket
33—Magazine housing

DETAILED DESCRIPTION OF THE INVENTION

This invention relates to a replaceable barrel block allowing use of different caliber ammunitions with the same gun by means of simply changing the barrel of a manual or semi-automatic air rifles and pistols driven by a pneumatic system.

In order to achieve the above mentioned, the air rifle and pistol is comprised of two parts, namely, the lower block (2) and the upper block (1). When it is desired to change the barrel of a rifle, the upper block is easily dismantled by means of a screw without need for a wrench or a tool. The barrel is thus located on the upper block (2) which also houses the correlated components that can also be separated from the lower block and the body of the gun.

The first of the two blocks is the lower block (2). The lower block contains the trigger group, air tube (5) and other conventional components required for carrying out the operation of a pneumatical rifle. Another component on the lower block (2) is the speed adjustment button (4). The speed adjustment button (4) is placed in such manner that it can open and close the air passage hole (31) on the lower block (2). The amount of air coming through the air tube (5) is adjusted by means of the air passage hole (31) which can be narrowed down by the speed adjustment button (4), and thus the velocity of the ammunition exiting the gun's barrel can be adjusted.

Also, a vertically oriented cylindrical motion pin (10), the air passage hole (31) and a sealing gasket (32) are located on the same lower block (2). Vertically oriented "U" shape fixing housing (29) is provided on the rear section while two lower block grooves (9) are provided on the top of the lower block. In another embodiment, the two lower block grooves (9) may be dovetail grooves. The lower block (2) is connected to the rifle or pistol stock by means of other components located thereon. This block remains fixed on the stock during replacement of the barrel.

The other part is the upper block (1) consisting of a replaceable barrel which constitutes essence of the invention. One end has a barrel housing (15) where a barrel connection place (18) of the barrel (17) sits and a barrel jacket connection extension (16) where the barrel jacket (20) is placed. The middle core part of the upper block (1) is drilled so that an ammunition sliding pin housing (12) is created such that ammunition sliding pin (13) can passes through it.

Also, the middle part of the upper block (1) has a magazine housing (33). The other end of the upper block (1) has a horizontally oriented fixing screw housing (11) where fixing screw (3) is located. The lower section of the upper block (1) contains two upper block grooves (8), which in another embodiment may be dovetails grooves, and air passage hole (30) similar to the lower block (2).

Barrels and ammunition sliding pins (13) of different calibers are installed onto the replaceable upper blocks (1) of the same characteristic features. For instance, barrel of 4.5 caliber and sliding pins matching it or barrel of 5.5 caliber and sliding pin matching it are installed onto upper blocks (1) of the same characteristic features. Thus, more than one upper block (1) of different calibers are packaged. When the user prefers to use barrel of different caliber on his/her rifle or pistol, s/he dismantles the current upper block (1) and replaces it with another upper block (1) to achieve a different caliber size. This swapping out of the barrel and upper block (1) is much simpler and easier than the one known in the related art.

Figure 3:
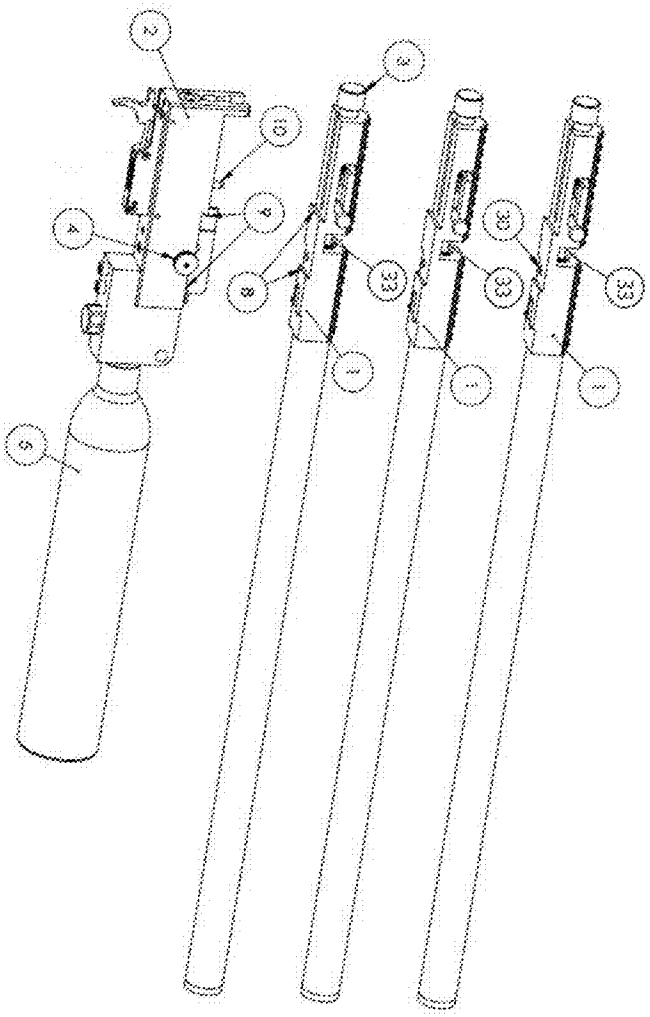
FIG. 3—illustrates a series of views where the upper block is separated from the lower block.
Figure 4:
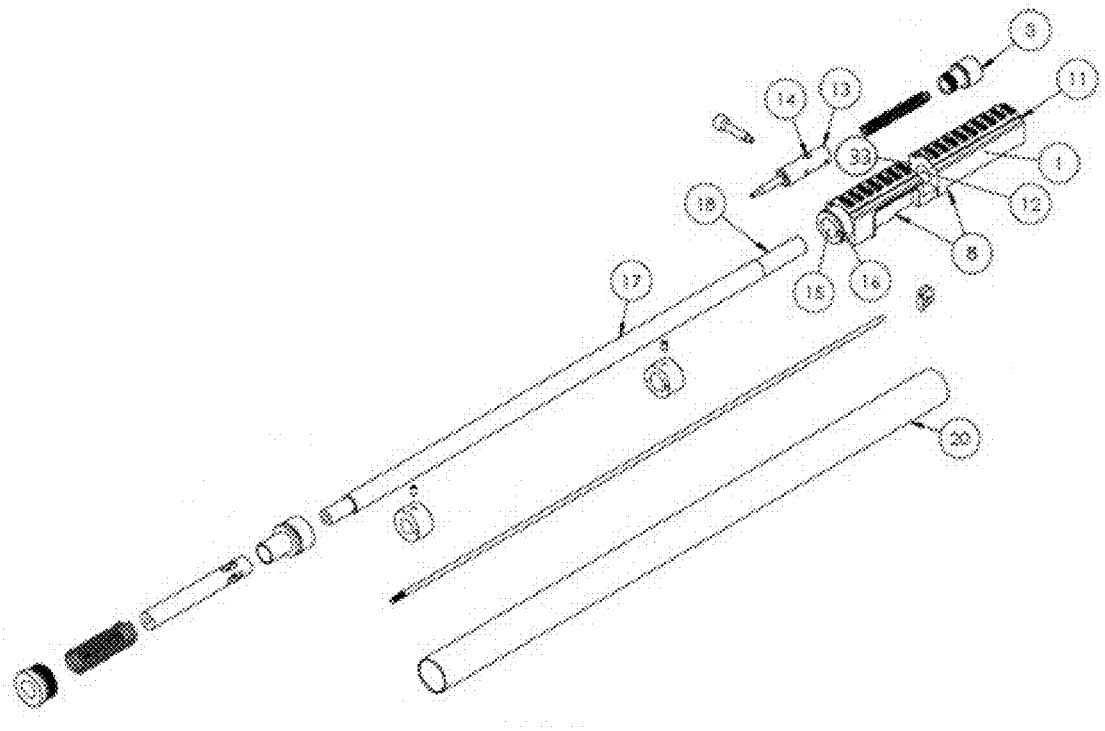
FIG. 4—is an exploded view of the upper block and all of its components contained within the upper block.
Figure 5:
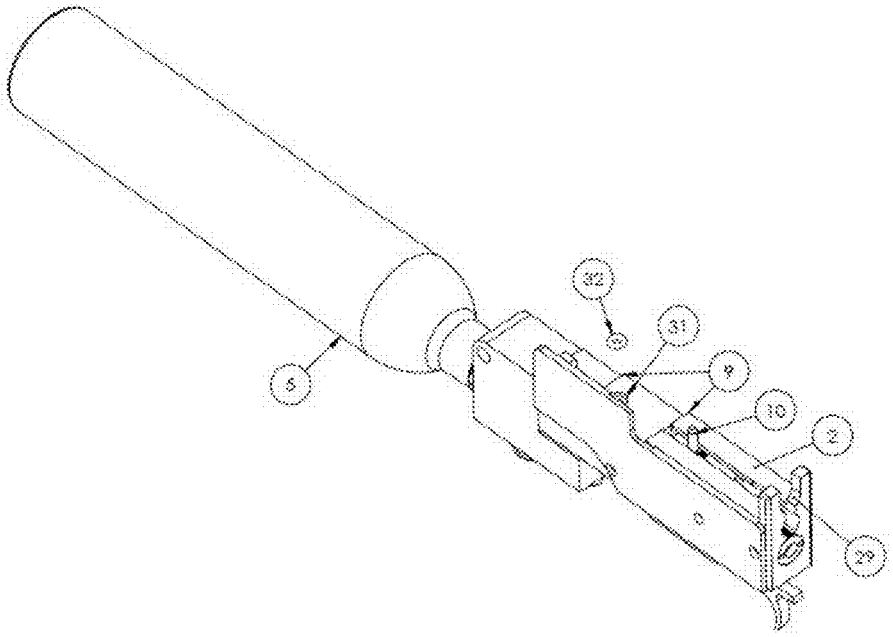
FIG. 5—is a general perspective view of the lower block when a replaceable upper block is removed.
Figure 6:
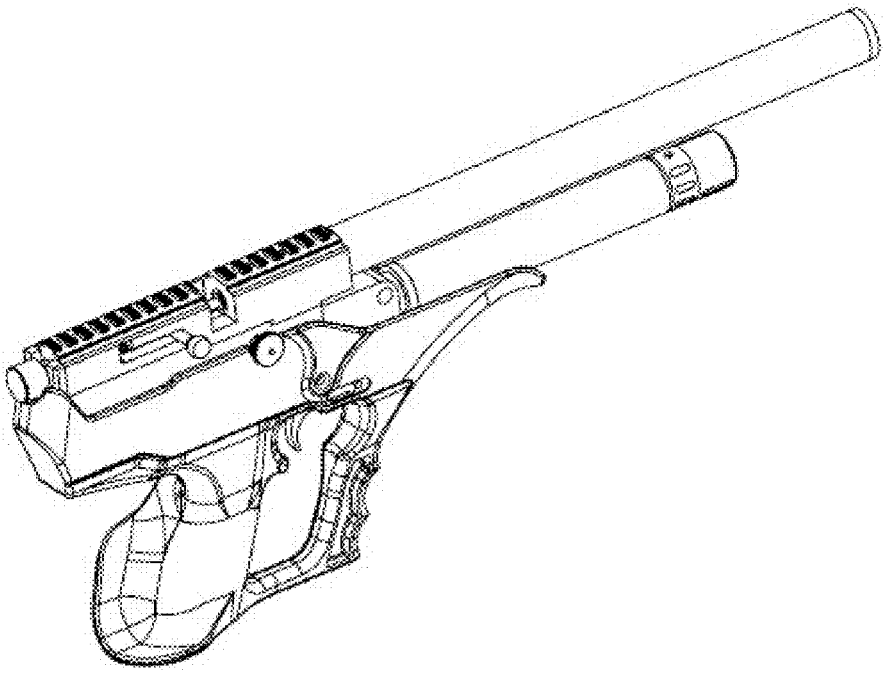
FIG. 6—is a general perspective view of a manual or a semi-automatic air pistol with a replaceable barrel block.

To swap the barrel and the upper block (1), the fixing screw (3) is slightly loosened and the upper block (1) is pushed forward to unmount the upper block (1) from the lower block (2). Thus, the dovetail grooves (8) on the upper block (1) are separated from the dovetail grooves (9) on the lower block (2) and so the upper block (1) is separated from the lower block (2) (see FIG. 3).

When a user desires to install an upper block (1) having barrel of different caliber, vertically oriented cylindrical motion pin (10) located on the lower block (2) is aligned to be inserted into the cylindrical motion pin housing (14) located on the ammunition sliding pin (13) further located on the upper block (1), and seated onto the lower block (2) in a manner so as to fit into this housing. Thus, components located on the replaceable upper block (1) are associated with the components located on the lower block (2). Meanwhile, the fixing screw (3) in the housing (29) on the lower block (2) is engaged. When the fixing screw (3) is tighten, the upper block (1) moves backward and sits flush with the lower block. This motion provides mating of the dovetail grooves (8) located on the upper block (1) with the dovetail grooves (9) located on the lower block (2) thereby locking the two blocks together. Meanwhile, the sealing gasket (32) is compressed between the lower block (2) and the upper block (1). The sealing gasket (32) thus seals and guides flow of air during shooting from the air passing through the tube (5) and into the air passage hole (31) on the lower block (2) as it travels to the upper block (1).

With this system, the barrel of the rifle or pistol is replaced by use of the upper block (1) that has a set caliber. The dovetail grooves (8/9) used here provide solid and rigid placement of the upper block (1) onto the lower block (2) and integrity with the lower block (2) is maintained.

As described above, a barrel and its components are combined in the system disclosed under this invention. Thus, a simple and uncomplicated embodiment is achieved.

When it is desired to replace the barrel of the rifle or the pistol, the replacement can be achieved by use of a screw, which can be removed manually without need for any tools (wrench etc.).

Another characteristic of the replaceable barrel block disclosed under the invention is that it is also applicable to both manual and semi-automatic air rifles and pistols driven by pneumatic system, which is not known in the related art.

The system developed under the invention provides the users with the advantage of using ammunition of different calibers with the same rifle.

What is claimed is:

1. A replaceable barrel mechanism comprising:

a lower block and an upper block, wherein the upper block is located above the lower block;

at least one upper block groove positioned under the upper block;

at least one lower block groove positioned on top of the lower block;

at least one fixing screw locking the upper block unto the lower block wherein the at least one fixing screw tightens a connection between the at least one upper block groove and the at least one lower block groove by horizontally sliding the upper block towards a rear end of the lower block such that the at least one upper block groove and the at least one lower block groove mate;

at least one horizontally oriented fixing screw housing located on a rear end of the upper block where the at least one fixing screw can be horizontally mounted;

at least one vertically oriented U-shaped fixing housing, located on the rear end of the lower block, wherein the at least one fixing screw is inserted through the at least one vertically oriented U-shaped fixing housing and into the at least one horizontally oriented fixing screw housing thereby securing the upper block to the lower block;

a vertically oriented cylindrical motion pin located on the lower block;

an ammunition sliding pin incorporating a cylindrical motion pin housing where the vertically oriented cylindrical motion pin inserts into, independent of a caliber of an ammunition used, wherein the vertically oriented cylindrical motion pin has substantially the same diameter as the cylindrical motion pin housing;

an ammunition sliding pin housing located in the upper block where the ammunition sliding pin moves back and forth;

a lower block air passage hole on top of the lower block where air can move through a mated section of the upper block and the lower block;

an upper block air passage hole under the upper block; and a sealing gasket located between the upper block and the lower block for sealing the moving air.

2. The replaceable barrel mechanism of claim 1, wherein the upper block further comprises at least one magazine housing.

3. The replaceable barrel mechanism of claim 1, wherein the at least one horizontally oriented fixing screw housing located on the rear end of the upper block has an opening with threads matching threads of the at least one fixing screw.

4. The replaceable barrel mechanism of claim 1, wherein the at least one upper block groove is a dovetail groove.

5. The replaceable barrel mechanism of claim 1, wherein the at least one fixing screw is tightened onto the upper block by rotating the at least one fixing screw into the at least one horizontally oriented fixing screw housing.

6. The replaceable barrel mechanism of claim 1, wherein the ammunition sliding pin is cylindrical and has a diameter correlating to the caliber of the ammunition used.

7. The replaceable barrel mechanism of claim 1, wherein the at least one lower block groove is a dovetail groove.

8. The replaceable barrel mechanism of claim 1, wherein the vertically oriented cylindrical motion pin conveys a motion of a trigger mechanism as the vertically oriented cylindrical motion pin is inserted into the cylindrical motion pin housing when the vertically oriented cylindrical motion pin is mated with the ammunition sliding pin.

9. The replaceable barrel mechanism of claim 1, wherein the sealing gasket is located between the upper block and the lower block providing an air tight seal thus ensuring against air leakage traveling from an air tube.

10. The replaceable barrel mechanism of claim 1, wherein the upper block air passage hole is of substantially the same diameter as the lower block air passage hole located on the lower block where both the upper block air passage hole and the lower block air passage hole align with one another.

* * * * *